US006550411B1

(12) United States Patent
Den Hartogh et al.

(10) Patent No.: US 6,550,411 B1
(45) Date of Patent: Apr. 22, 2003

(54) METHOD FOR REMOVING A JACKET OF A DRILLING OR PRODUCTION RIG AND VESSEL PROVIDED WITH A DEVICE THEREFOR

(75) Inventors: Frans Ariën Den Hartogh, Delft (NL); Klaas Boudwijn Van Gelder, Delft (NL)

(73) Assignee: Excalibur Engineering B.V., Delft (NL)

( * ) Notice: Subject to any disclaimer, the term of this patent is extended or adjusted under 35 U.S.C. 154(b) by 0 days.

(21) Appl. No.: 10/018,493

(22) PCT Filed: Jun. 8, 2000

(86) PCT No.: PCT/NL00/00397

§ 371 (c)(1),
(2), (4) Date: Apr. 4, 2002

(87) PCT Pub. No.: WO00/77306

PCT Pub. Date: Dec. 21, 2000

(30) Foreign Application Priority Data

Jun. 14, 1999 (NL) ..... 1012314

(51) Int. Cl.[7] ..... B63B 35/44

(52) U.S. Cl. ..... 114/258; 405/206; 405/209; 114/44

(58) Field of Search ..... 114/44, 45, 258–260; 405/206, 209

(56) References Cited

U.S. PATENT DOCUMENTS 4,683,832 A * 8/1987 Dysarz ..... 114/258
4,927,296 A * 5/1990 Kaldenbach ..... 405/206
5,097,786 A * 3/1992 Sheffield ..... 114/258

* cited by examiner

*Primary Examiner*—Jesus D. Sotelo
(74) *Attorney, Agent, or Firm*—Webb Ziesenheim Logsdon Orkin & Hanson, P.C.

(57) ABSTRACT

A method for removing a jacket of a drilling or production rig using a vessel provided with a deck includes manoeuvring the vessel close to the jacket, hoisting the jacket, and tilting the jacket relative to a tilting point located close to an edge of the deck of the vessel until the jacket lies on the deck, wherein the side of the jacket directed toward the vessel is supported during the tilting, such that the jacket can be removed in one operation and carried away using the vessel. A vessel with a deck and a device for removing a jacket of a drilling or production rig is also disclosed.

18 Claims, 6 Drawing Sheets

METHOD FOR REMOVING A JACKET OF A DRILLING OR PRODUCTION RIG AND VESSEL PROVIDED WITH A DEVICE THEREFOR

BACKGROUND OF THE INVENTION

1. Field of the Invention

The present invention relates to a method for removing a jacket of a drilling or production rig using a vessel provided with a deck. The invention also relates to a vessel provided with a deck and a device for removing a jacket of a drilling or production rig.

2. Description of the Related Art

An immobile drilling or production rig comprises a superstructure and a jacket by means of which the rig is anchored in the sea or ocean bed in which it is situated. After the rig has completed its task, it will have to be disassembled and removed in accordance with international regulations. After the superstructure has been removed from the rig, the jacket anchored in the bottom remains behind. At the moment this jacket, which normally consists of 4–10 legs and a framework arranged between the legs, is cut into smaller, manageable pieces under water. The pieces are then lifted out of the water using a normal crane arranged on a vessel. The drawbacks hereof are that it is a time-consuming and costly process. In addition, performing cutting operations, particularly in the case of such a colossal jacket, is not wholly without risk. Finally, the hoisting capacity of known ship's hoists is limited, whereby the whole removal process is limited to hoisting pieces of a jacket of a determined weight and/or dimension.

SUMMARY OF THE INVENTION

The object of the present invention is to provide a method for removing a jacket of a drilling or production rig, wherein the above-stated drawbacks are obviated. Another object of the invention is to provide a vessel provided with a deck and a device for removing a jacket of a drilling or production rig, wherein the above-stated drawbacks are obviated.

For this purpose a method is provided according to the present invention for removing a jacket of a drilling or production rig using a vessel provided with a deck, comprising of manoeuvring the vessel close to the jacket, hoisting the jacket and tilting the jacket relative to a tilting point located close to an edge of the deck of the vessel until the jacket lies on the deck, wherein the side of the jacket directed toward the vessel is supported during the tilting. It is hereby possible to remove the jacket in one operation and carry it away using the vessel. Another advantage of the method according to the invention is that the jacket only has to be hoisted to a limited height. A further advantage is that since the jacket is removed in its entirety it is possible to re-use this jacket. The jacket can however also be disassembled into smaller pieces on the deck of the vessel, this being easier to carry out than under water, as is done according to the method known from the prior art.

The jacket is preferably supported non-slidably relative to the tilting point during tilting. The jacket is thus tilted relative to a fixed point until it lies on the deck.

In order to have the tilting progress in controllable manner the centre of gravity of the jacket and elements connected tiltably thereto is preferably located during the tilting on the side of the tilting point remote from the vessel.

After tilting the jacket is preferably shifted further onto the deck so as to enable cutting thereof into smaller pieces or to enable shipping to another location for disassembly or re-use.

In addition, a vessel is provided according to the present invention which is provided with a deck and a device for removing a jacket of a drilling or production rig, wherein the device comprises:

- at least one support beam which is tiltable transversely of an edge of the deck of the vessel,
- hoisting means connected to at least one support beam for hoisting the jacket,
- tilting means for tilting the or each support beam relative to the vessel, and
- support means for supporting the jacket which are provided on the side of the support beam remote from the vessel.

Using this vessel a jacket of a drilling or production rig that has to be disassembled and removed after use thereof can be taken out of the water in its entirety and be placed on the deck of the vessel. Using the device for removing the jacket the hoisting height is kept as limited as possible, and a relatively simple and inexpensive construction is thereby obtained which is capable of hoisting even the largest jackets of roughly 20,000 tonnes.

The hoisting means preferably comprise one or more hoisting cables and one or more cable jacks which engage on the or each hoisting cable. The piston of such a cable jack is alternately retracted and extended. Wedge-shaped clamping means automatically clamp the hoisting cable(s) and pull them through the cable jack when the piston is extended, and then lock the hoisting cable(s) in a new position when the piston retracts to its starting position. The cable jacks hoist one or more hoisting cables through a distance substantially equal to the stroke of the piston. Such a cable jack is for instance shown in the U.S. Pat. No. 5,083,469. The advantage of using cable jacks as hoisting means is that they are relatively simple, light and inexpensive.

In a preferred embodiment a projecting member is arranged pivotally on the end of the support beam lying uppermost during hoisting, and the hoisting means comprise at least one jack for the projecting member arranged between the support beam and the end of the projecting member remote from the support beam. The jack for the projecting member can be used to hoist the jacket over a relatively small distance for a relatively short time, this being necessary to "pull loose" the jacket from the sea or ocean bed. In addition, the hoisting cable(s) can be tightened using such a jack for the projecting member in order to develop lifting power.

The device, and preferably the or each jack for the projecting member, is provided with a swell-compensating mechanism. If the device for removing a jacket arranged on the vessel is coupled via the hoisting means to the jacket still anchored in the seabed, a compensation is required for displacements of the vessel relative to the jacket resulting from waves.

The tilting means preferably comprise a winch placed on the deck of the vessel and one or more winch cables arranged between the winch and the support beam. Using these tilting means the support beam and the jacket supported on the side of the support beam remote from the vessel can be tilted transversely of the edge of the deck.

In a preferred embodiment there are provided shifting means for shifting at least the jacket further onto the deck. After the hoisting and tilting the jacket can be shifted by means hereof to a desired position on the deck to be further disassembled or shipped to another location for disassembly or re-use.

The shifting means preferably comprise the tilting means. In a particularly advantageous embodiment the shifting means, which shift the jacket further onto the deck, also serve to tilt the support beam, whereby a saving in material, and thus weight, of the removing device is obtained.

The support means are preferably also displaceable transversely of the support beam in order to likewise enable good support of jackets with downward diverging legs during the tilting.

In order enable placing of the support beam in a practically upright hoisting position, it is provided with a ballast weight.

The ballast weight is preferably adjustable so as to be able to influence the position of the centre of gravity of the jacket and the support beam, which forms an element connected tiltably to the jacket.

In an advantageous embodiment the device for removing a jacket of a drilling or production rig comprises two support beams, which are each mounted pivotally on the edge of the deck of the vessel, and at least the one support beam is displaceable relative to the other along the edge of the vessel. By means of this device different jackets with 4–10 legs can be removed, wherein the distance between the support beams can be adjusted subject to the dimension of the jacket.

The pivotal mounting is herein preferably releasable in order to enable shifting of the tilted jacket with support beam further onto the deck.

BRIEF DESCRIPTION OF THE DRAWINGS

The invention will now be further elucidated with reference to the annexed drawings. In the drawing.

DETAILED DESCRIPTION OF THE PREFERRED EMBODIMENTS

Figure 1:
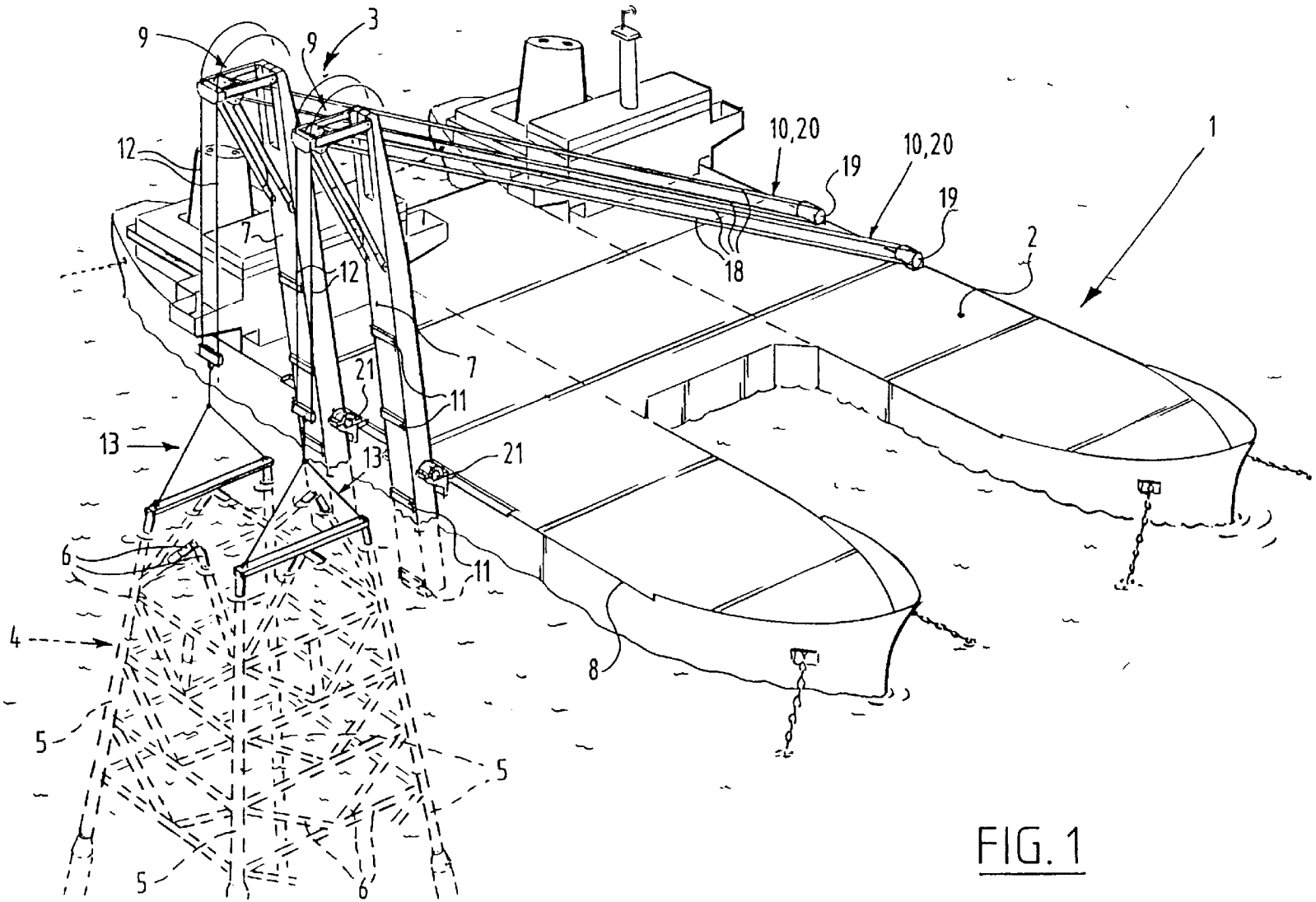
FIG. 1 shows a perspective view of a vessel provided with a device for removing a jacket of a drilling or production rig according to the present invention.

FIG. 1 shows a perspective view of a vessel 1 provided with a deck 2 and a device 3 for removing a jacket 4 of a drilling or production rig. Jacket 4 has four legs 5 which diverge downward relative to each other. Legs 5 are mutually connected by connecting rods 6 in the form of frameworks.

Device 3 for removing a jacket 4 comprises two support beams 7 which are tiltable transversely of an edge 8 of deck 2 of vessel 1, and hoisting means 9 connected to each support beam 7 for hoisting jacket 4. In addition, the removing device 3 comprises tilting means 10 for tilting each support beam 7 relative to vessel 1 and support means 11 for supporting the jacket 4 which are provided on the side of support beam 7 remote from vessel 1. Hoisting means 9 comprise one or more hoisting cables 12 which are connected in known manner to a bearing structure 13 which is fixed to the upper side of jacket 4. For fixing of bearing structure 13 to the upper part of jacket 4 hydraulic clamps can for instance be arranged in the legs or crane hooks can be welded on legs 5 close to the upper side of jacket 4, or, if still present, the crane hooks used in the installation of jacket 4 can be used. A last option is the use of external clamps, for instance when legs 5 are filled with concrete. The form of vessel 1, but also other elements not associated with removing device 3 which are provided on vessel 1, are not significant for the present invention and are not therefore described here.

Figure 2:
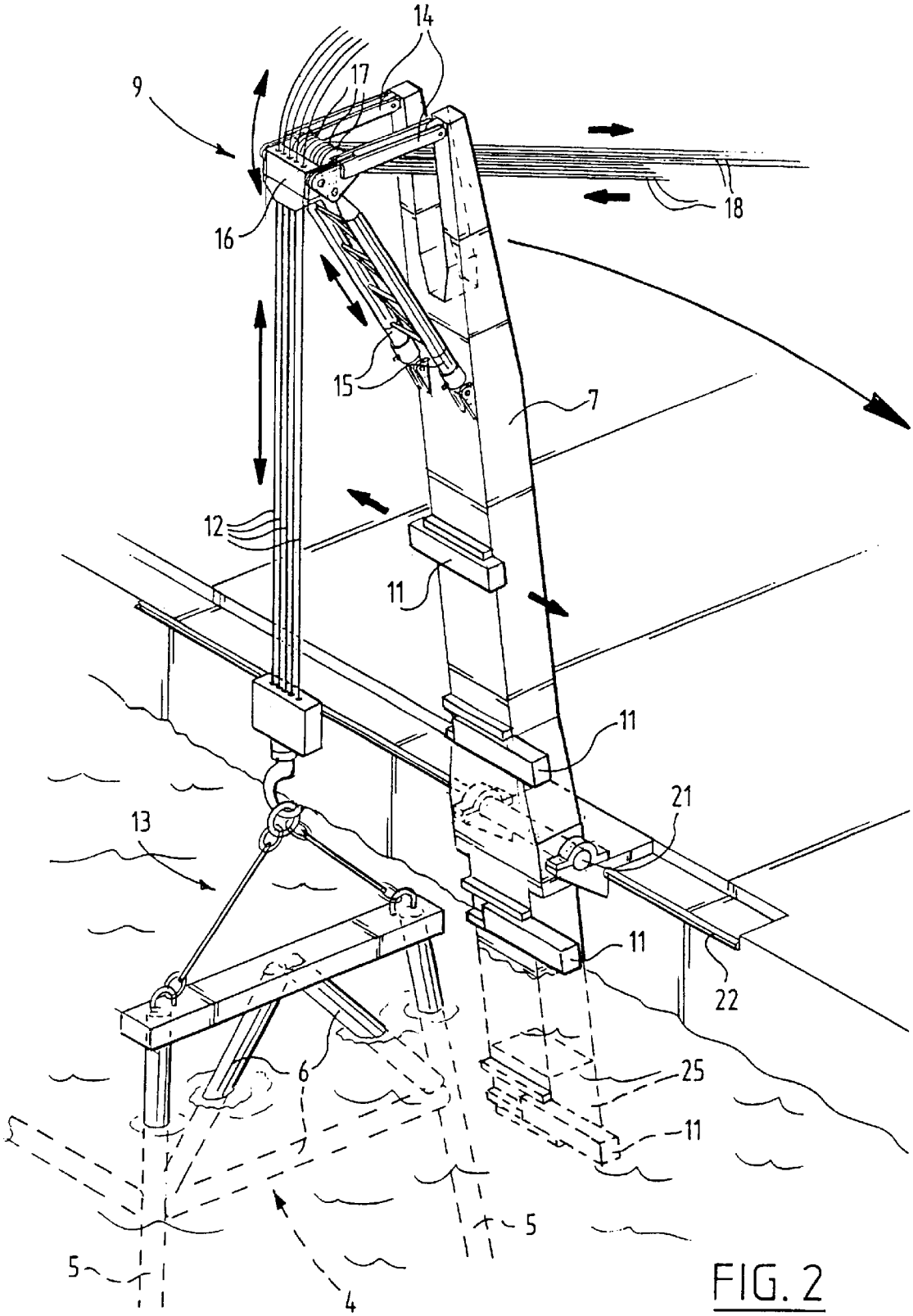
FIG. 2 shows a perspective detail view of the vessel of FIG. 1, and FIGS. 3–10 show schematic front views of the vessel of FIG. 1, by means of which the different steps of the method for removing a jacket of a drilling or production rig according to the invention are shown.
Figure 3:
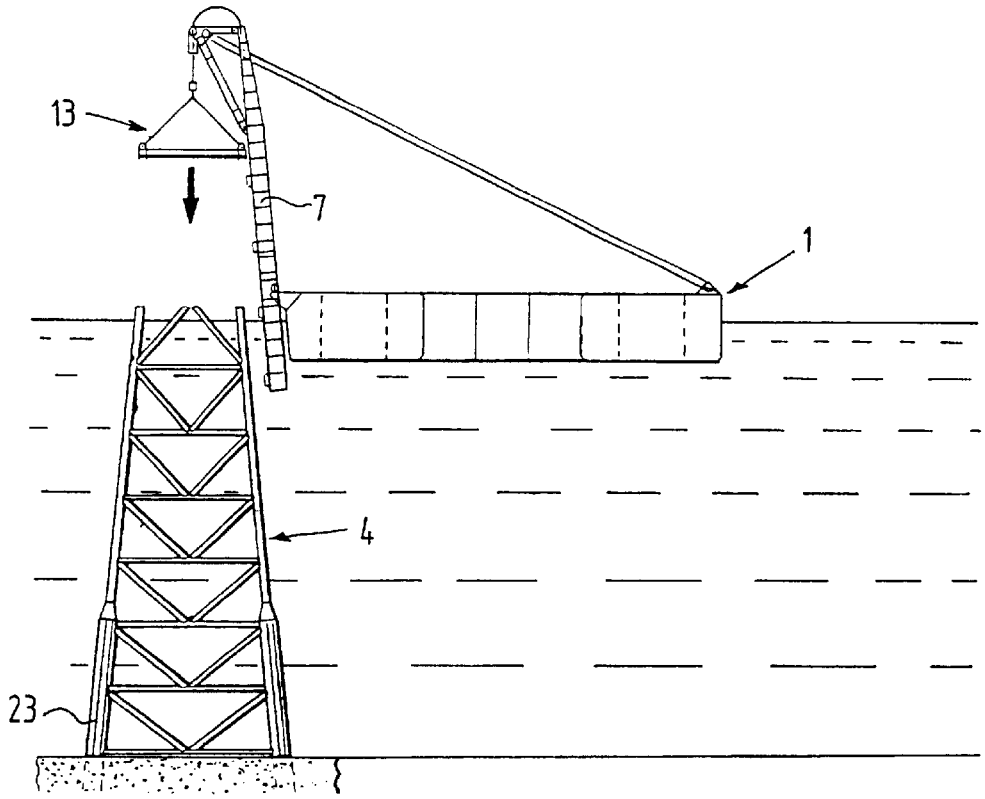

In FIG. 2 a more detailed view is shown of vessel 1 of FIG. 1, wherein only a part of the device 3 for removing a jacket 4 shown in FIG. 1 is depicted. In FIG. 2 the directions of movement of the different elements of removing device 3 are indicated with arrows. The support beam 7 tiltable transversely of the edge 8 of deck 2 of vessel 1 is provided on the side remote from vessel 1 with support means 11 displaceable transversely of support beam 7. Two projecting members 14 are arranged pivotally on the end of support beam 7 lying uppermost during hoisting. In addition, two jacks 15 for the projecting members are arranged between support beam 7 and the ends of projecting members 14 remote from the support beam. These jacks 15 for the projecting members form part of the hoisting means 9 for hoisting the jacket 4. In addition, hoisting means 9 comprise a number of hoisting cables 12 and a number of cable jacks. 16, which each engage on a hoisting cable 12. Cable jacks 16 are arranged between the ends of projecting members 13 remote from support beam 7 and are shown schematically in FIG. 2. Hoisting cables 12 extend through the cable jacks and extend freely in the air, as shown in FIG. 2. During hoisting these free ends of hoisting cables 12 can optionally be received in a hollow space provided in support beam 7. At their other ends the hoisting cables 12 are connected to bearing structure 13, which is in turn attached to the upper part of jacket 4.

Discs 17 over which run winch cables 18 are likewise arranged between the ends of projecting members 13 remote from support beam 7. As can be seen in FIG. 1, these winch cables 18 run to the opposite side of vessel 1, where a winch 19 is placed for each support beam 7. Support beams 7 are tilted relative to vessel 1 using winches 19, winch cables 18 and discs 17. Winches 19, winch cables 18 and discs 17 therefore form the tilting means 10. They also form shifting means 20 for further shifting of jacket 4 onto the deck.

Support beam 7 is mounted pivotally at 21 to the edge 8 of deck 2 of vessel 1. At least the one support beam 7 is preferably displaceable relative to the other along the edge of the vessel, for instance by means of guide means 22. The pivotal mounting 21 is releasable, when jacket 4 is shifted further onto deck 2, in order to allow the jacket 4 to rest on support beam 7 and to enable jacket 4 to be pulled onto the deck together with support beam 7.

With reference to the schematic side views shown in FIGS. 3–10, a preferred embodiment of the method for removing a jacket 4 of a drilling or production rig according to the present invention will be elucidated. The vessel shown in FIGS. 1 and 2 is used herein.

Figure 4:
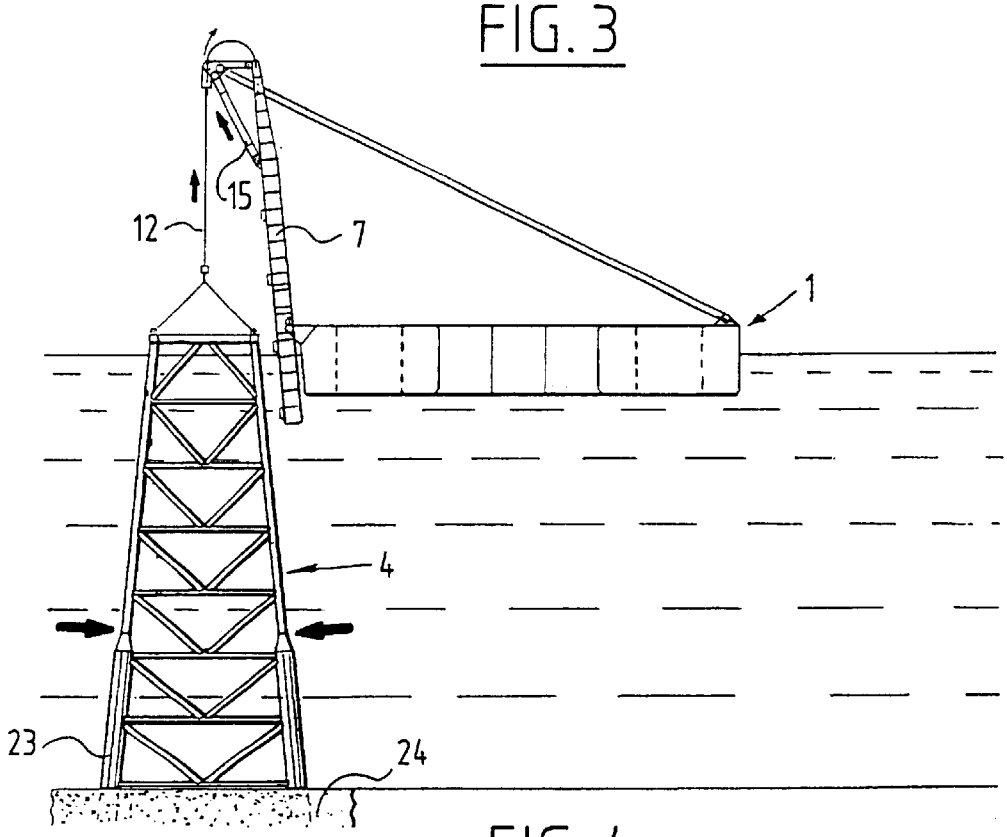

In order to remove jacket 4 of a drilling or production rig, the support beams 7 of removing device 3 are tilted to their hoisting position, i.e. in a substantially upright position as shown in FIG. 1. Tilting of each support beam 7 to the hoisting position can take place by means of a ballast weight in the end of support beam 7 protruding over the deck in tilted position, the position of which beam is controlled by means of winch cables 18 and winch 19. The ballast weight can for instance be formed by a (fillable) water tank 25. Vessel 1 is manoeuvred close to jacket 4 and the bearing structures 13 fixed to hoisting cables 12 are lowered (FIG. 3) and fixed to the upper part of jacket 4 (FIG. 4).

In FIGS. 3–10 a jacket 4 of one of the larger dimensions is removed, which is provided with a base 23. In such a case it is allowed to leave the base 23 behind. As indicated in FIG.

Figure 5:
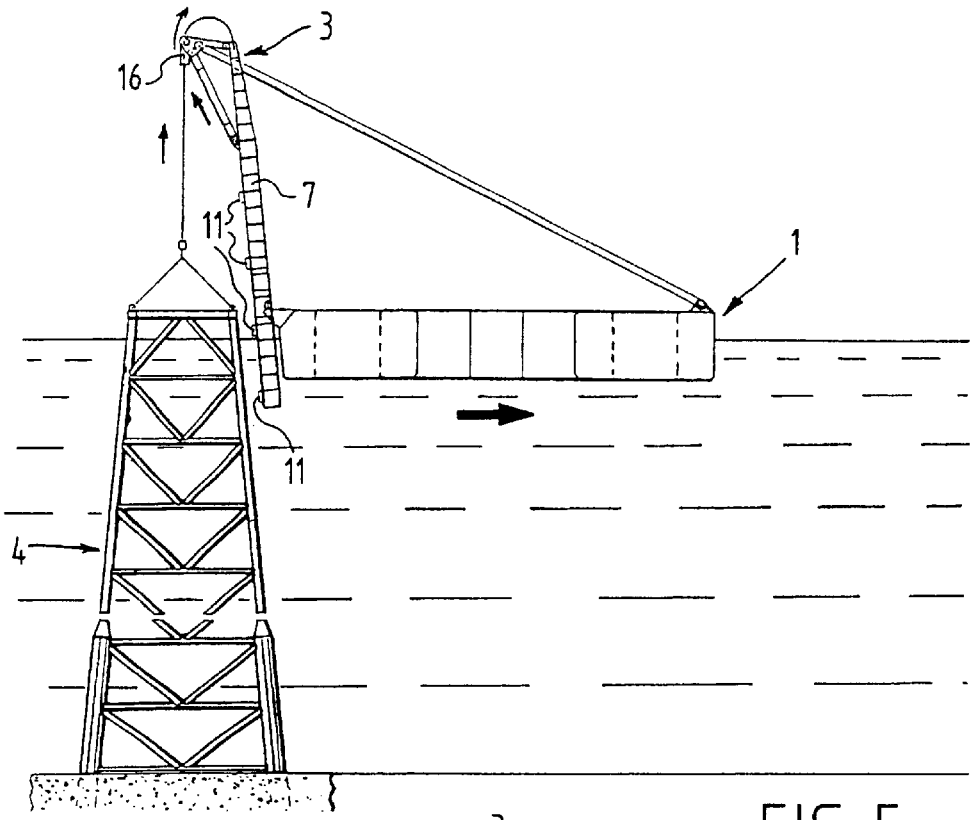
Figure 6:
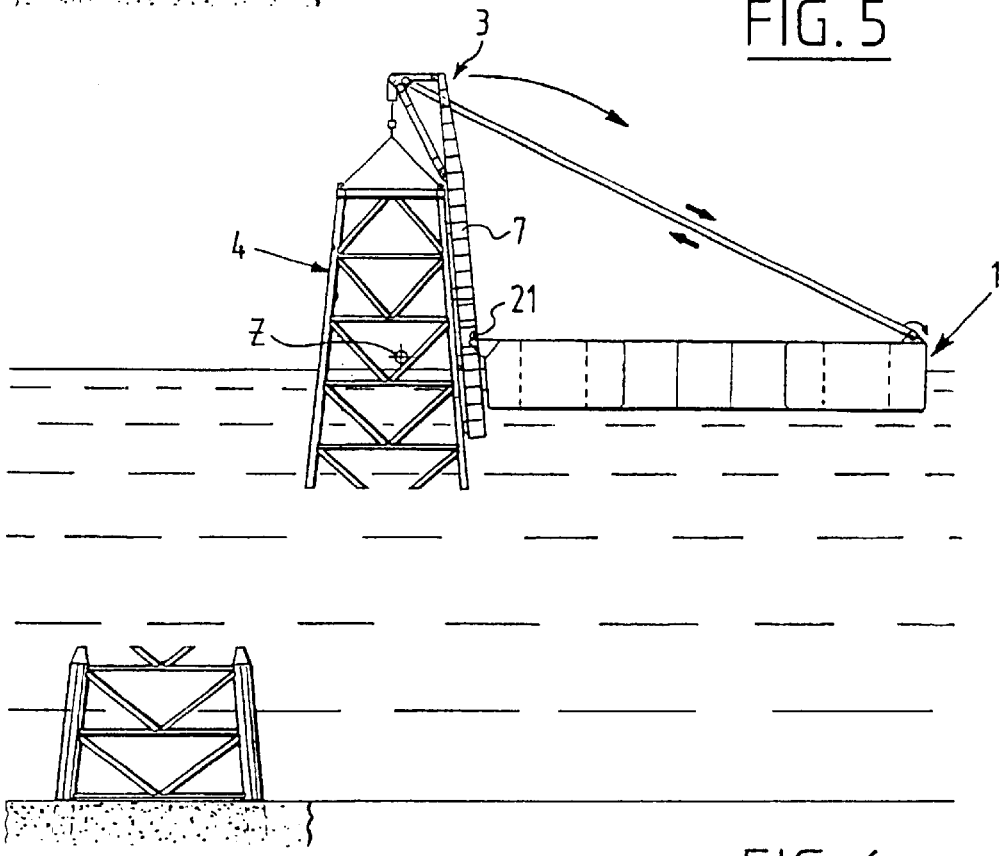
Figure 7:
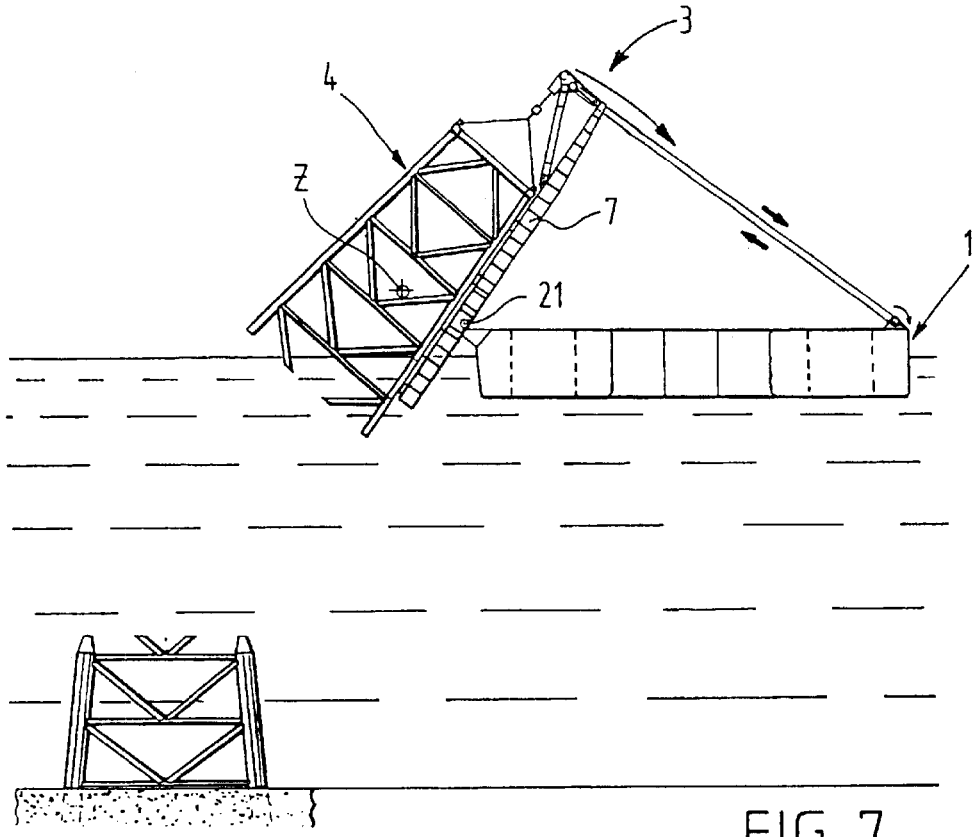
Figure 8:
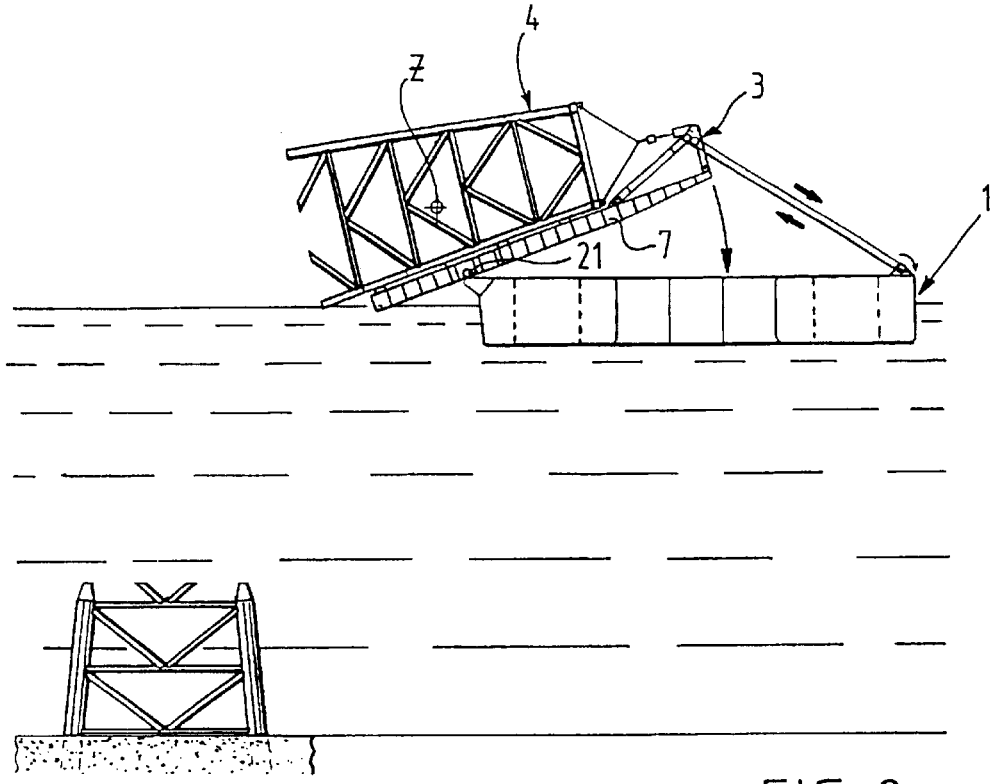
Figure 9:
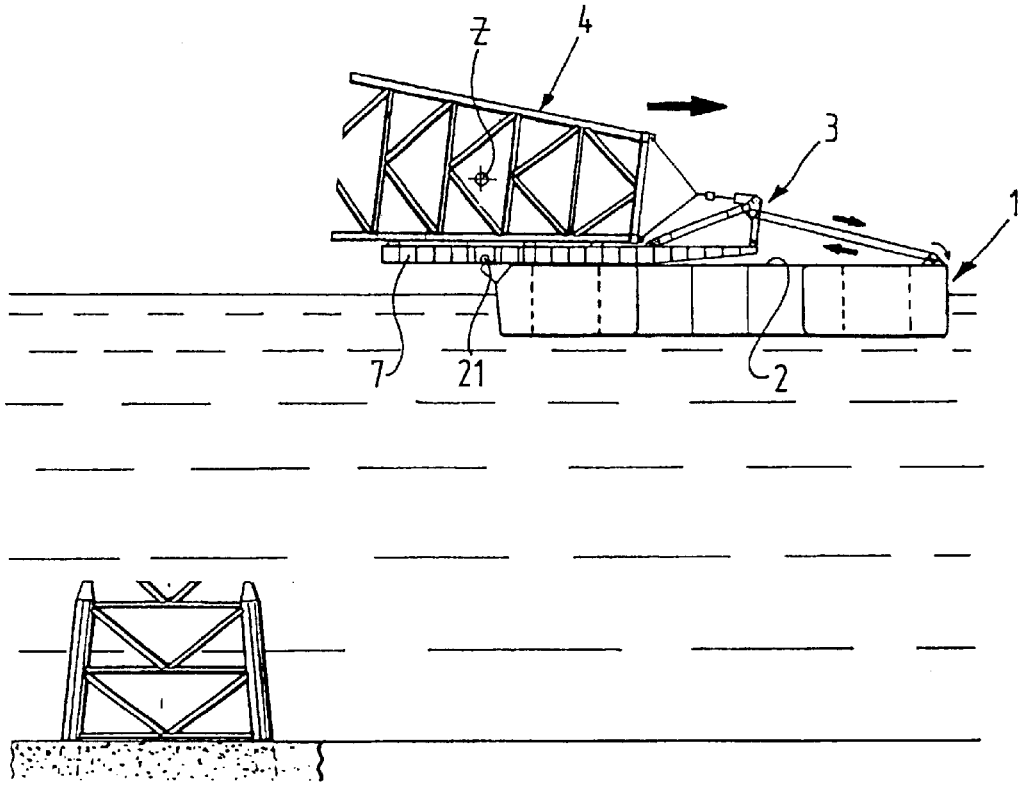
Figure 10:
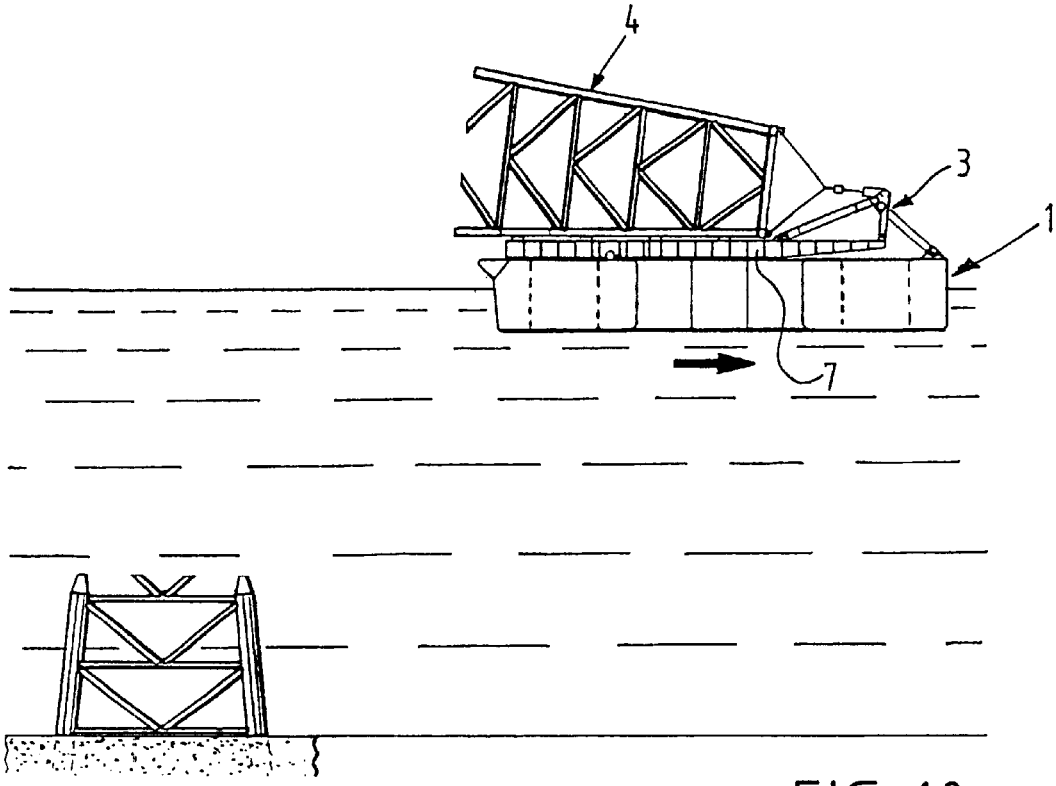

4 with two arrows, jacket 4 is cut loose from its base 23 and hoisting of jacket 4 can begin. Hoisting preferably takes place in three steps, this as follows. Hoisting cables 12 are first of all tightened by pressure build-up in jacks 15 for the projecting members. Once 80–90% of the lifting power has been developed, jacket 4 is raised in a relatively short time over a height of several metres, for instance 2 m, using the jacks 15 for the projecting members. Jacket 4 is hereby pulled from its base 23 or out of seabed 24, as shown in FIG. 5. From this moment the vessel 1 can already sail away. Jacket 4 is lifted further to a desired height using cable jacks 16, wherein it comes to lie with the side directed toward vessel 1 against support means 11 on support beams 7. This situation is shown in FIG. 6. As indicated with arrows in FIG. 6, the support beams 7 with jacket 4 situated thereon are then tilted relative to the tilting point 24 located close to the edge 8 of deck 2 of vessel 1, wherein support beams 7 support the jacket 4 during tilting. During tilting the jacket 4 is supported non-slidably by the hoisting means 9 arranged between each support beam 7 and jacket 4. If the centre of gravity Z of jacket 4 and elements connected tiltably thereto lies during the tilting on the side of tilting point 24 remote from vessel 1, in FIGS. 6–8 on the left-hand side of tilting point 24, support beams 7 with jacket 4 situated thereon cannot collapse and the tilting of jacket 4 will take place in controlled manner. Jacket 4 is tilted until it lies on deck 2, as shown in FIG. 9. After tilting the jacket 4 can be shifted further onto deck 2 (FIG. 10), preferably using the same means as are used for tilting jacket 4. Finally, the vessel 1 can sail away with jacket 4 situated thereon.

The jacket 4 can have 4–10 legs, but for the sake of simplicity is shown in the figures in its simplest embodiment. If jacket 4 contains for instance 8 legs, the middle legs are preferably each supported by a support beam 7.

It is finally noted that the vessel according to the present invention can also be used to instal a jacket for a drilling or production rig, wherein the above described operations are performed in reverse sequence.

What is claimed is:

1. A method for removing a jacket of a drilling or production rig using a vessel provided with a deck, comprising the steps of manoeuvring the vessel close to the jacket, hoisting the jacket, and tilting the jacket relative to a tilting point located close to an edge of the deck of the vessel until the jacket lies on the deck, wherein a side of the jacket directed toward the vessel is supported during the tilting.

2. The method as claimed in claim 1, wherein the jacket is supported non-slidably relative to the tilting point during tilting.

3. The method as claimed in claim 1, wherein the centre of gravity of the jacket and elements connected tiltably thereto is located during the tilting on the side of the tilting point remote from the vessel.

4. The method as claimed in claim 1, further including the step of, after tilting, shifting the jacket further onto the deck.

5. A device for removing a jacket of a drilling or production rig and located on a vessel having a deck, comprising:

at least one support beam, the at least one support beam being tiltable transversely of an edge of the deck of the vessel, hoisting means connected to the at least one support beam for hoisting the jacket, tilting means for tilting the at least one support beam relative to the vessel, and support means for supporting the jacket, the support means provided on the side of the at least one support beam remote from the vessel.

6. The device as claimed in claim 5, wherein the hoisting means include one or more hoisting cables and one or more cable jacks, the one or more cable jacks engage on the one or more hoisting cables.

7. The device as claimed in claim 5, further including a projecting member arranged pivotally on an end of the at least one support beam lying uppermost during hoisting, wherein the hoisting means include at least one jack for the projecting member, the at least one jack arranged between the at least one support beam and an end of the projecting member remote from the at least one support beam.

8. The device as claimed in claim 5, further including a swell-compensating mechanism.

9. The device as claimed in claim 5, wherein the tilting means include a winch placed on the deck of the vessel and one or more winch cables arranged between the winch and the at least one support beam.

10. The device as claimed in claim 5, further including shifting means for shifting at least the jacket further onto the deck.

11. The device as claimed in claim 10, wherein the shifting means include the tilting means.

12. The device as claimed in claim 5, wherein the support means are displaceable transversely of the at least one support beam.

13. The device as claimed in claim 5, wherein the at least one support beam includes a ballast weight.

14. The device as claimed in claim 13, wherein the ballast weight is displaceable along the at least one support beam.

15. The device as claimed in claim 5, wherein the at least one support beam includes two support beams, the two support beams each mounted pivotally on the edge of the deck of the vessel to enable the tiltability of the two support beams, and at least one of the two support beams is displaceable relative to the other of the two support beams along an edge of the vessel.

16. The device as claimed in claim 15, wherein the pivotal mounting of the two support beams is releasable.

17. The device as claimed in claim 7, further including a swell-compensating mechanism, wherein the at least one jack for the projecting member includes a second swell-compensating mechanism.

18. The device as claimed in claim 5, wherein the at least one support beam is mounted pivotally on the edge of the deck of the vessel to enable the tiltability of the at least one support beam, and the pivotal mounting of the at least one support beam is releasable.

* * * * *